US007230193B2

(12) United States Patent
Chou

(10) Patent No.: US 7,230,193 B2
(45) Date of Patent: Jun. 12, 2007

(54) JERK-INITIATED SWITCH

(75) Inventor: Tien-Ming Chou, No. 41, San-Hsi 5th St., Taichung City (TW)

(73) Assignee: Tien-Ming Chou, Taichung (TW)

( * ) Notice: Subject to any disclaimer, the term of this patent is extended or adjusted under 35 U.S.C. 154(b) by 0 days.

(21) Appl. No.: 11/181,310

(22) Filed: Jul. 14, 2005

(65) Prior Publication Data

US 2007/0012552 A1 Jan. 18, 2007

(51) Int. Cl.
*H01H 35/14* (2006.01)

(52) U.S. Cl. ..... 200/61.45 R; 200/61.52

(58) Field of Classification Search ..... 200/61.45 R, 200/61.52, 61.46–48, 61.51; 340/565, 566, 340/546, 547, 545.1, 429, 689
See application file for complete search history.

(56) References Cited

U.S. PATENT DOCUMENTS 5,955,713 A * 9/1999 Titus et al. ..... 200/61.52
6,011,254 A * 1/2000 Sano et al. ..... 200/61.52
6,115,929 A * 9/2000 Tanazawa et al. ..... 33/366.24
6,140,635 A * 10/2000 Kazumi et al. ..... 200/61.45 R
6,348,665 B1 * 2/2002 Ohashi et al. ..... 200/61.52
6,518,523 B1 * 2/2003 Chou ..... 200/61.52
6,559,396 B1 * 5/2003 Chou ..... 200/61.52
6,690,457 B2 * 2/2004 Yamaguchi ..... 200/61.52
6,740,867 B2 * 5/2004 Chou ..... 200/61.45 R
6,800,841 B1 * 10/2004 Chou ..... 250/231.1
2003/0057361 A1 * 3/2003 Chou ..... 250/221

* cited by examiner

*Primary Examiner*—Tu Ba Hoang
*Assistant Examiner*—M. Fishman
(74) *Attorney, Agent, or Firm*—Ohlandt, Greeley, Ruggiero & Perle L.L.P.

(57) ABSTRACT

A jerk-initiated switch includes a housing having an inner housing wall which defines an accommodation chamber therein. First and second terminals are disposed to define a switching action enabling path of a straight length that crosses the accommodation chamber. A ball member and a momentum reducing member are disposed in the accommodation chamber. When the housing is jerked, the ball member is displaceable from a first position, where the ball member is disposed to interrupt the switching action enabling path to establish a first electric switching state, to a second position, where the ball member is disposed outside the switching action enabling path to establish a second electric switching state. The momentum reducing member is configured to yield under impact from the ball member to reduce the momentum of the ball member when the ball member is displaced from the first position to the second position.

11 Claims, 15 Drawing Sheets

JERK-INITIATED SWITCH

BACKGROUND OF THE INVENTION

1. Field of the Invention

This invention relates to a jerk-initiated switch, more particularly to a jerk-initiated switch having a momentum reducing member which is yieldable under impact from a ball member so as to reduce the momentum of the ball member when the switch is jerked.

2. Description of the Related Art

A conventional vibration switch capable of instantly changing its switching state when jerked by a force coming from any direction generally includes a housing and a ball rollable in the housing to be displaceable when the housing is caused to quiver in an unsteady state so as to effect a change of an electric switching state. However, the ball will produce a clattering sound when it hits against the housing.

SUMMARY OF THE INVENTION

The object of the present invention is to provide a jerk-initiated switch which can prevent generation of a clattering sound when the switch is jerked.

According to this invention, the jerk-initiated switch includes a housing adapted to be mounted on a support in an upright direction, and having an inner housing wall which defines an accommodation chamber therein. First and second terminals are disposed to define a switching action enabling path of a straight length that crosses the accommodation chamber, and are coupled to effect a change of an electric switching state in response to an interruption of the switching action enabling path. A ball member is received rollably in the accommodation chamber, and is configured such that when the housing is jerked, the ball member is displaceable from a first position, where the ball member is disposed to interrupt the switching action enabling path so as to establish a first electric switching state, to a second position, where the ball member is disposed outside the switching action enabling path so as to establish a second electric switching state. A momentum reducing member is disposed in the accommodation chamber, and is configured to yield under impact from the ball member so as to reduce momentum of the ball member when the ball member is displaced from the first position to the second position.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
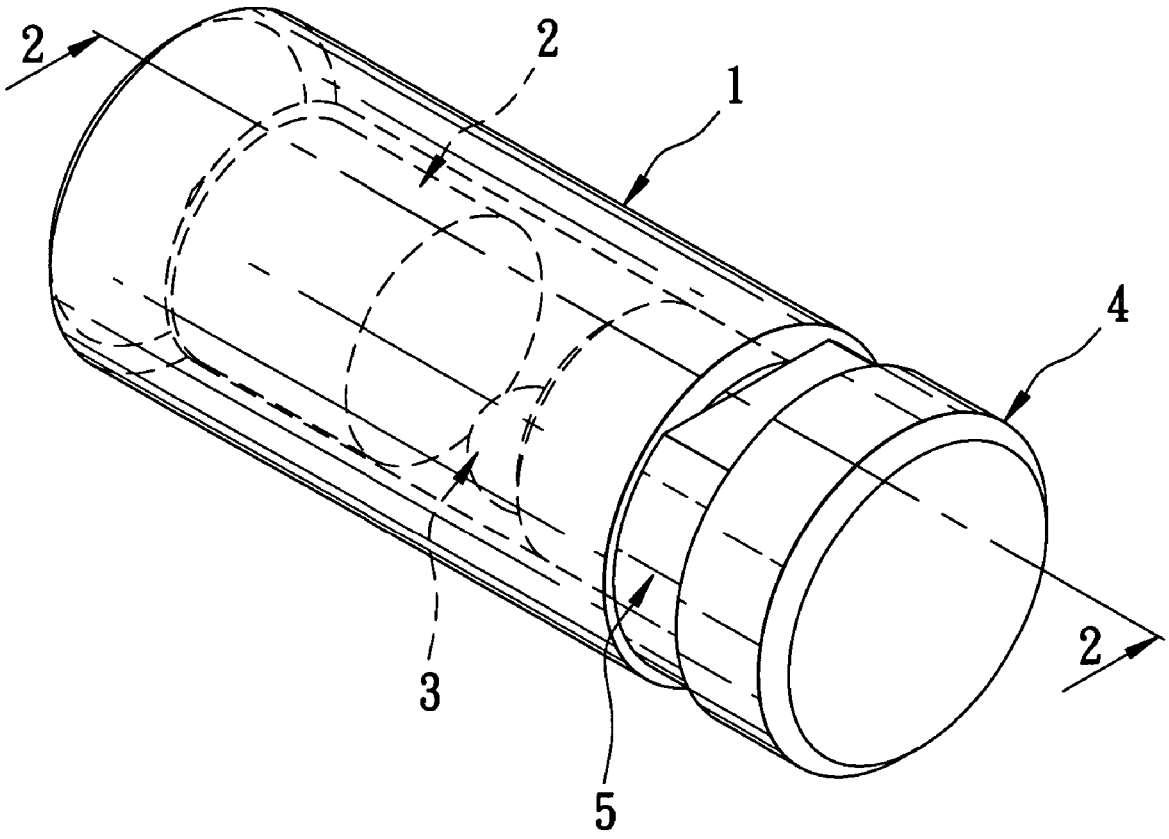
FIG. 1 is a perspective view of the first preferred embodiment of a jerk-initiated switch according to this invention.

Before the present invention is described in greater detail, it should be noted that same reference numerals have been used to denote like elements throughout the specification.

Figure 2:
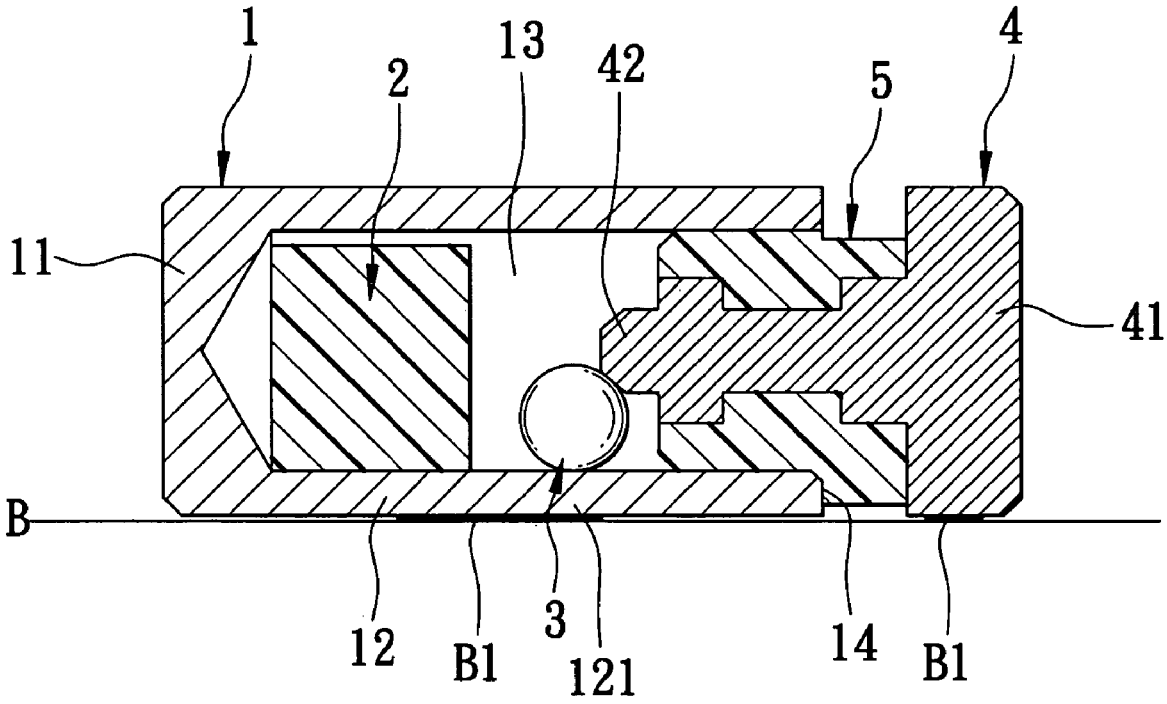
FIG. 2 is a longitudinally sectional view of the first preferred embodiment in an upright state, taken along lines 2—2 of FIG. 1.

Referring to FIGS. 1 and 2, the first preferred embodiment of a jerk-initiated switch according to the present invention is shown to be mounted on and to be in electric contact with a support (B), such as a circuit board, and comprises an electrically conductive housing 1 adapted to be mounted on the support (B) in an upright direction. The housing 1 is made from a metal material, and has an inner housing wall including a base wall 11 and a surrounding wall 12 which extends from a periphery of the base wall 11 to define an accommodation chamber 13 therein and which terminates at an opened end 14. The surrounding wall 12 has a part to serve as a first terminal 121 which is electrically connected to a copper foil (B1) of the support (B). A cover 4, which is made from a metal material, includes a connecting portion 41 which is electrically connected to another copper foil (B1) of the support (B), and an electric contact portion 42 which extends into the accommodation chamber 13 and which is insulated from the first terminal 121 by a plastic insulating piece 5 so as to serve as a second terminal. The first and second terminals 121, 42 define a switching action enabling path of a straight length that crosses the accommodation chamber 13, and are coupled to effect a change of an electric switching state in response to an interruption of the switching action enabling path.

Figure 3:
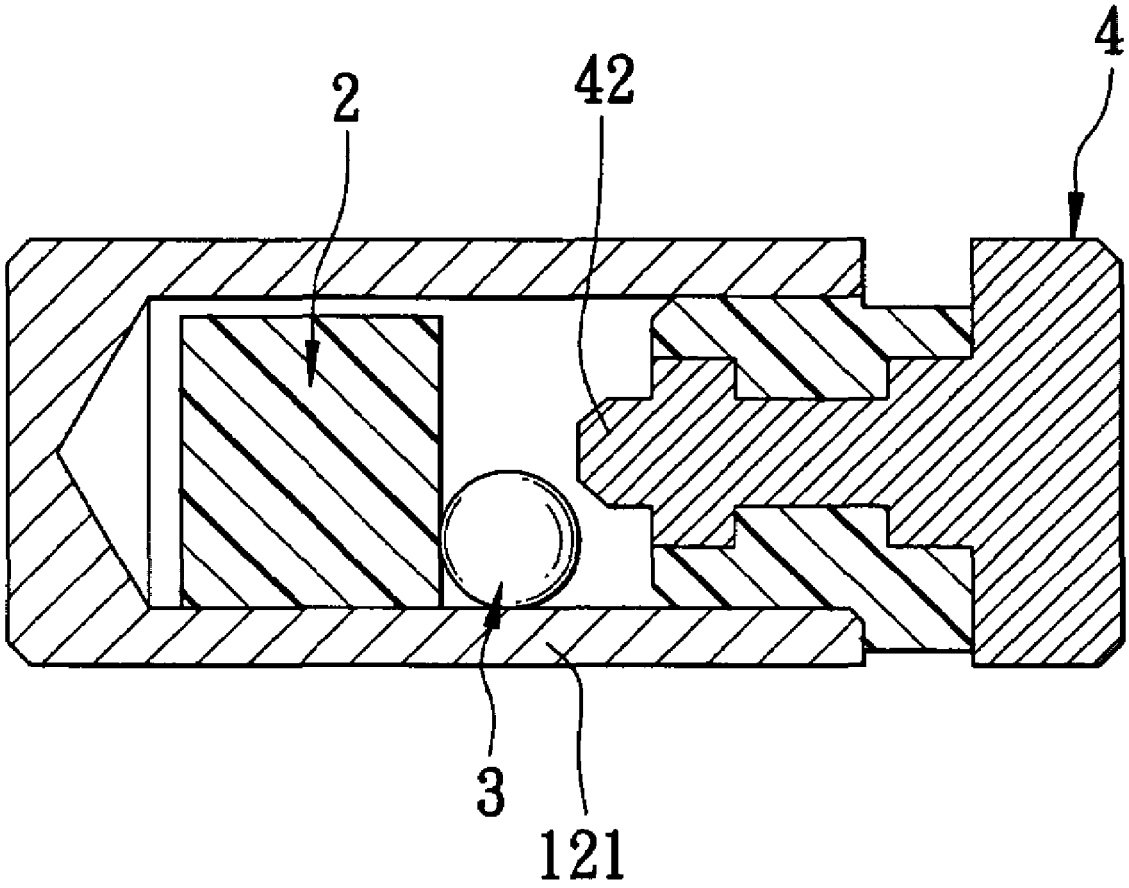
FIG. 3 is a view similar to FIG. 2, but showing the first preferred embodiment in a jerked state.

A ball member 3, which is made from an electrically conductive material such as metal, is received rollably in the accommodation chamber 13. Thus, when the housing 1 is jerked, the ball member 3 is displaceable from a first position, as shown in FIG. 2, where the ball member 3 is disposed to interrupt the switching action enabling path and is in contact with the first and second terminals 121, 42 so as to establish a first electric switching state (a switch-on state), to a second position, as shown in FIG. 3, where the ball member 3 is disposed outside the switching action enabling path and is out of contact with the second terminal 42 so as to establish a second electric switching state (a switch-off state).

A momentum reducing member is movably disposed in the accommodation chamber 13, and includes a deformable block 2 which is made of plastic, rubber, silica gel, etc. Thus, when the deformable block 2 yields (i.e., deformed and moved) under impact from the ball member 3 once the ball member 3 is displaced from the first position to the second position, the deformable block 2 is moved away from the switching action enabling path so as to reduce the momentum of the ball member 3, thereby reducing a clattering sound generated as a result of the ball member 3 hitting against the metal housing 1.

Figure 4:
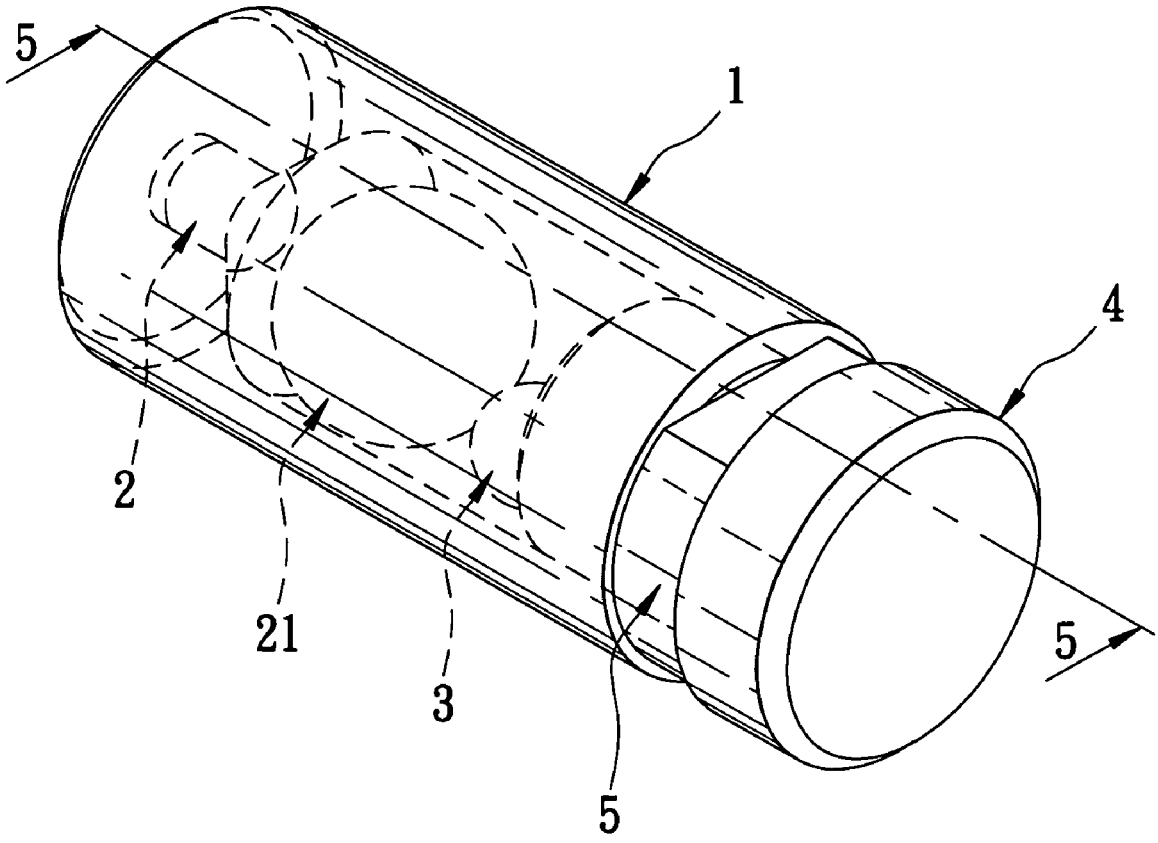
FIG. 4 is a perspective view of the second preferred embodiment of a jerk-initiated switch according to this invention.
Figure 5:
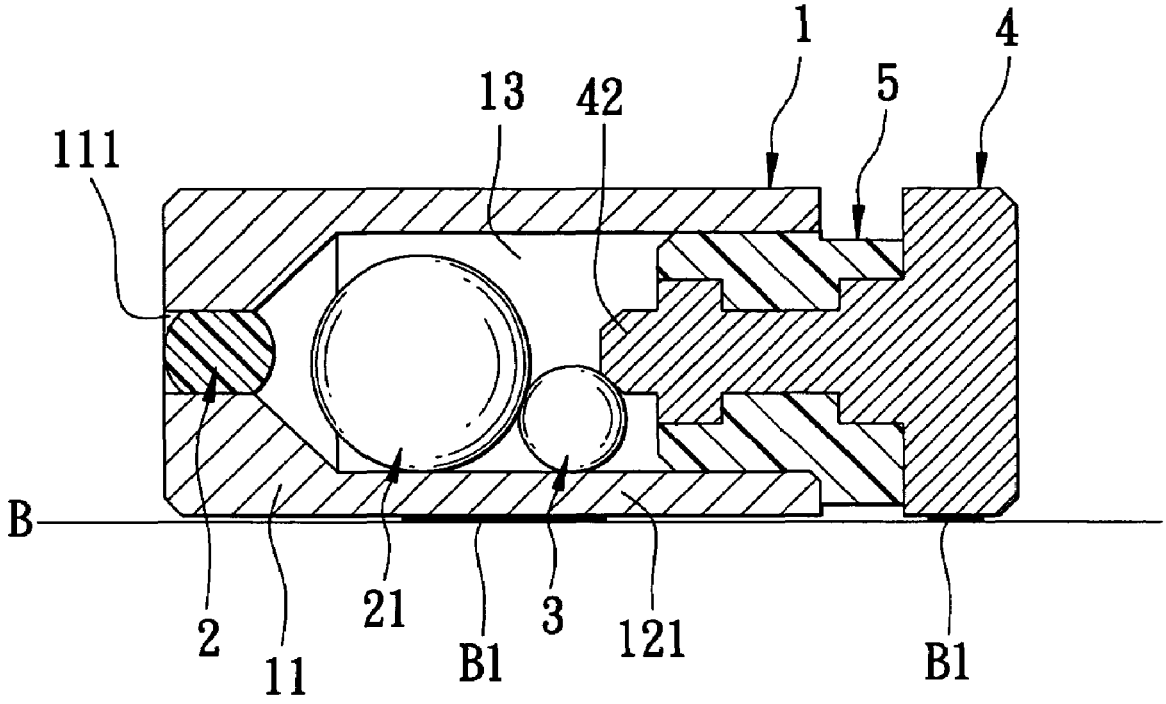
FIG. 5 is a longitudinally sectional view of the second preferred embodiment in an upright state, taken along lines 5—5 of FIG. 4.
Figure 6:
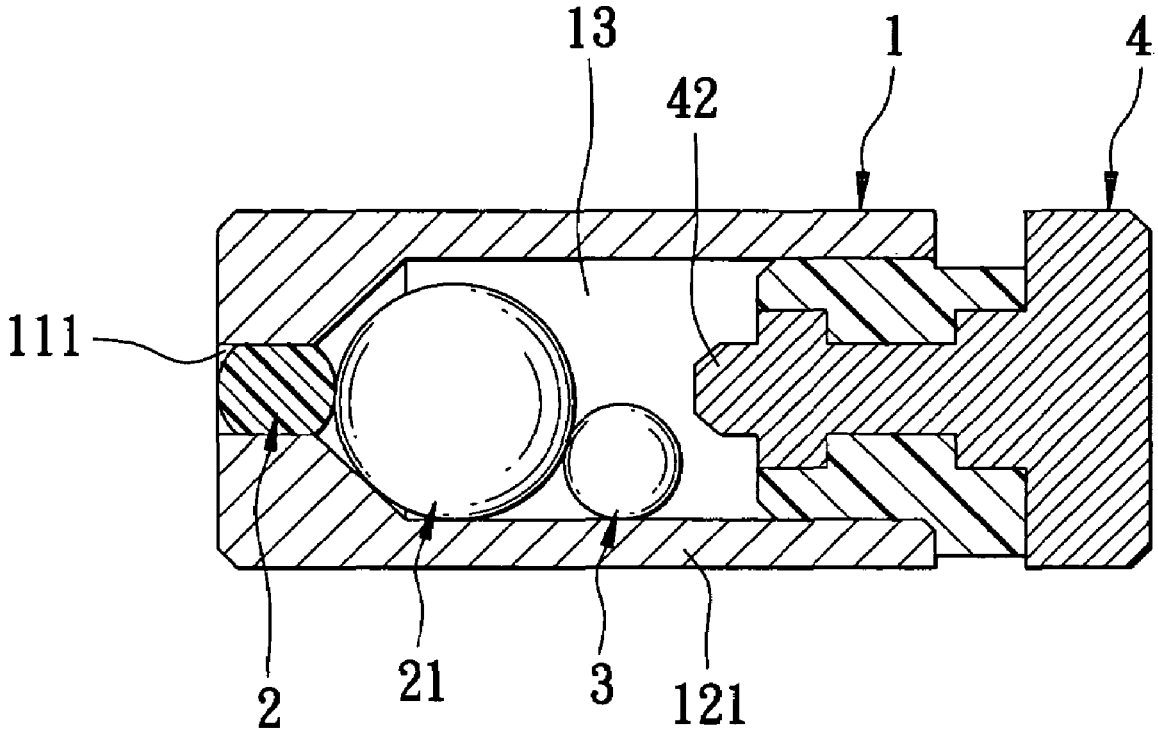
FIG. 6 is a view similar to FIG. 5, but showing the second preferred embodiment in a jerked state.

Referring to FIGS. 4 to 6, the second preferred embodiment of a jerk-initiated switch according to this invention is similar to the first preferred embodiment in construction, except that the deformable block 2 of the momentum reducing member is fitted into a through hole 111 formed in the base wall 11 of the housing 1. The deformable block 2 is disposed at an opposite side of the accommodation chamber 13 relative to the second terminal 42, and is disposed proximate to the second position of the ball member 3 and distal from the first position of the ball member 3. In addition, the momentum reducing member further includes a rollable body 21 which is interposed between the ball member 3 and the deformable block 2 and which is larger than the ball member 3 in mass such that the momentum of the ball member 3 is reduced when the ball member 3 is displaced and impacts against the rollable body 21. Moreover, due to the arrangement of the rollable body 21, the electric connection between the first and second terminals 121, 42 can be more stable.

Figure 7:
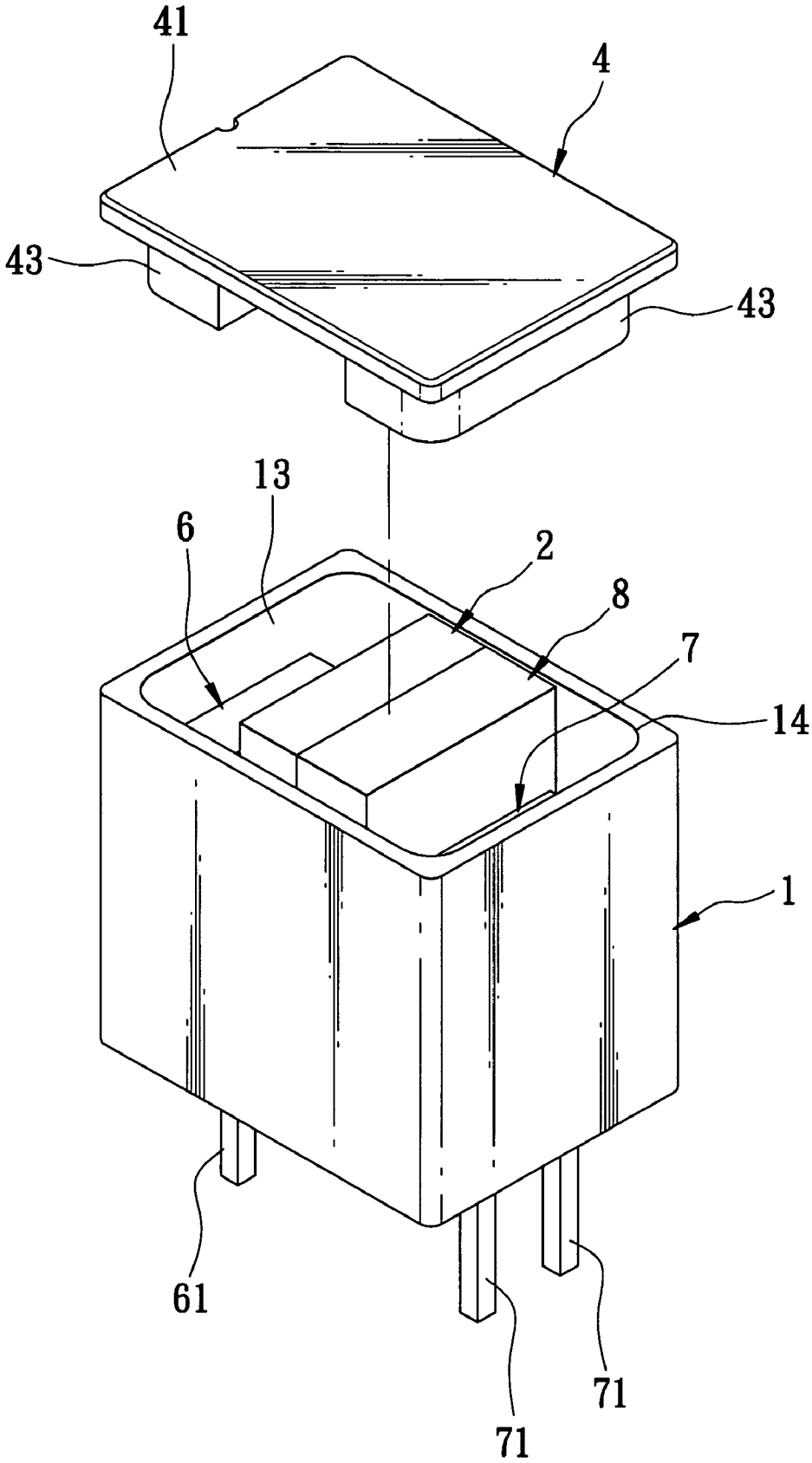
FIG. 7 is an exploded perspective view of the third preferred embodiment of a jerk-initiated switch according to this invention.
Figure 8:
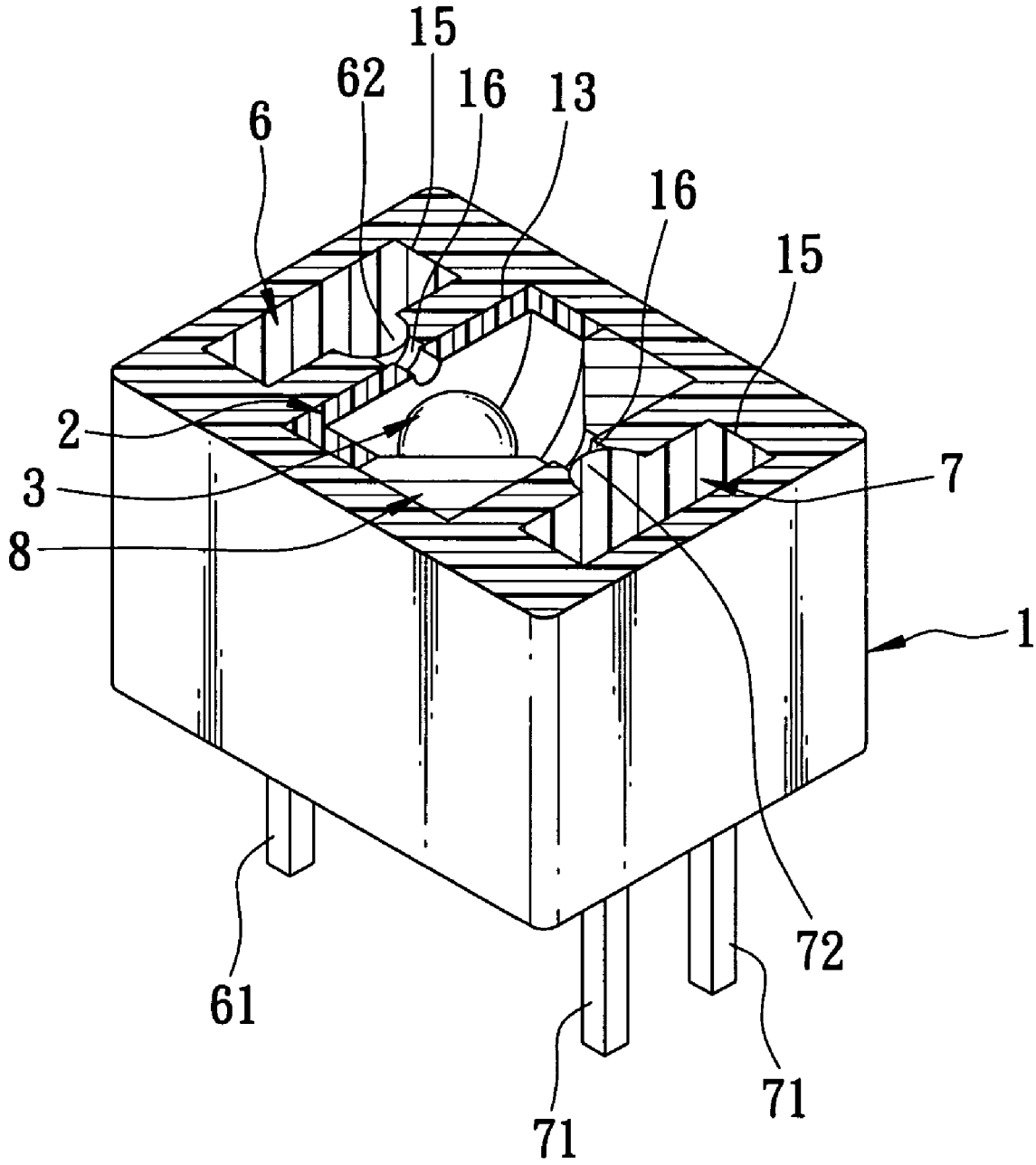
FIG. 8 is a partly cutaway perspective view of the third preferred embodiment.
Figure 9:
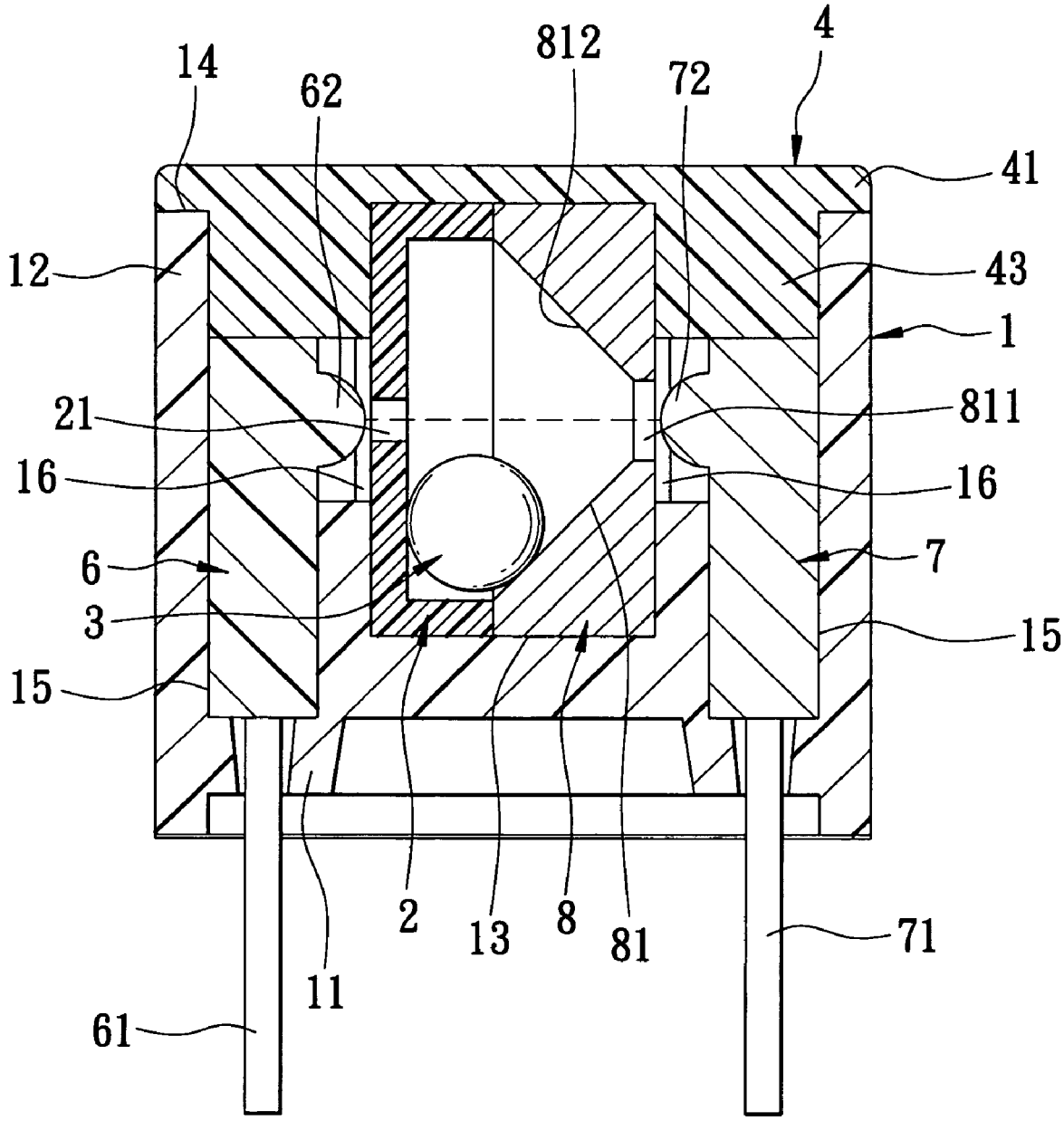
FIG. 9 is a longitudinally sectional view of the third preferred embodiment.

Referring to FIGS. 7 to 9, the third preferred embodiment of a jerk-initiated switch according to this invention is shown to comprise a housing 1 which is made from an insulating material, a ball member 3, an optoelectronic sensor member, a momentum reducing member having a deformable block 2, and a cover 4.

The housing 1 includes a base wall 11 and a surrounding wall 12 which extends from a periphery of the base wall 11 in an upright direction to define an accommodation chamber 13 therein and which terminates at an opened end 14. Two concavities 15 are formed in the surrounding wall 12 opposite to each other in a transverse direction relative to the upright direction, and are communicated with the accommodation chamber 13 by emitting and receiving slots 16, respectively.

The optoelectronic sensor member includes an infrared light emitter 6 and an optoelectronic switch 7, which are fittingly received in the concavities 15, respectively. The infrared light emitter 6 has an emitting point 62 which serves as a light emitting unit, and two electric contact terminals 61 which are electrically connected to the emitting point 62 and which extend outwardly and downwardly of the housing 1 to serve as a first terminal. The optoelectronic switch 7 has a receiving point 72 which serves as a light receiving unit, and two electric contact terminals 71 which are electrically connected to the receiving point 72 and which extend outwardly and downwardly of the housing 1 to serve as a second terminal. The emitting point 62 and the receiving point 72 respectively define a light emitting path and a light receiving path, which cooperatively serve as the switching action enabling path. The electric contact terminals 61, 71 are adapted to be connected electrically to a support (not shown).

Figure 10:
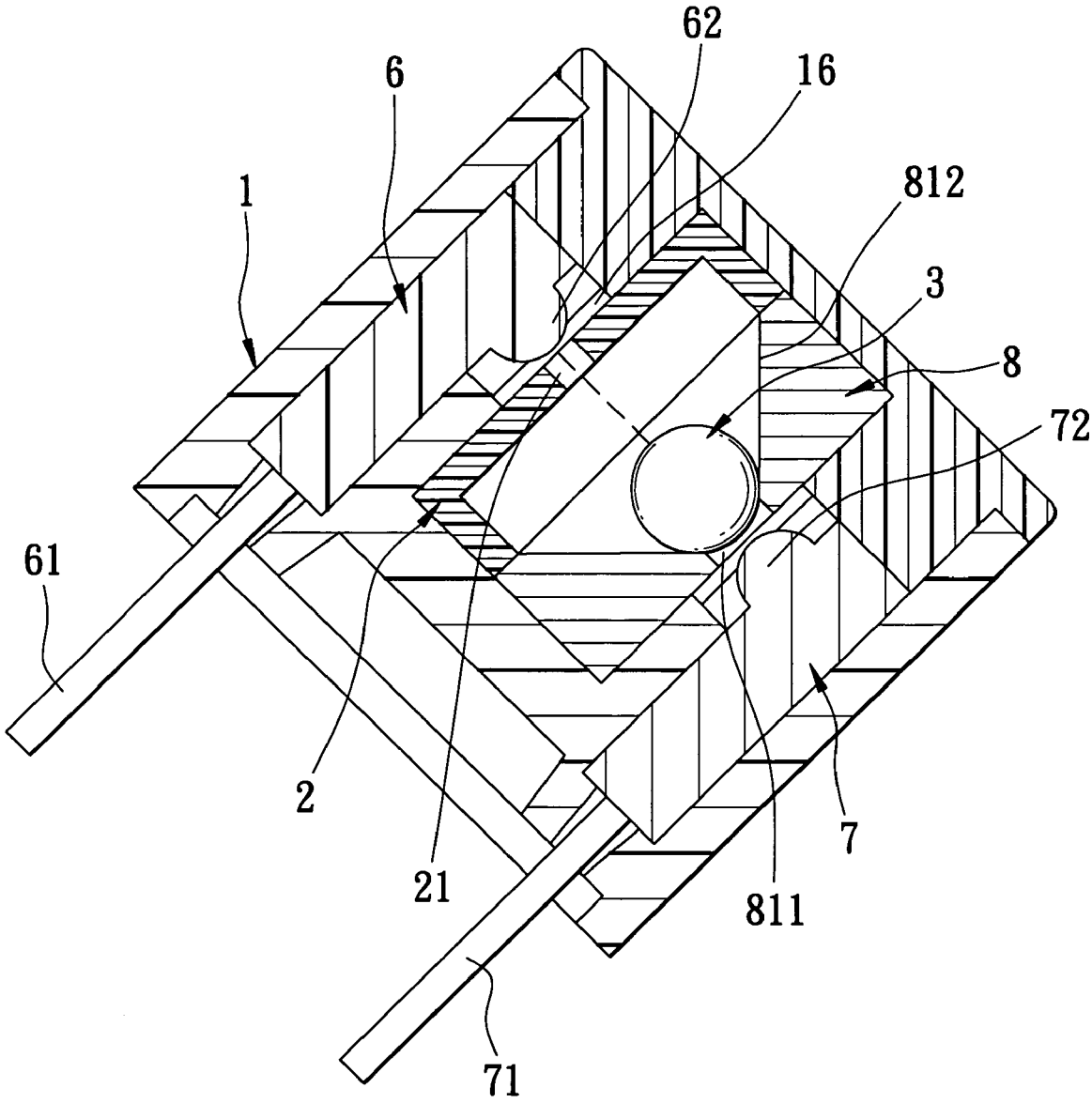
FIG. 10 is a view similar to FIG. 9, but showing the third preferred embodiment in a jerked state.

The housing 1 further has a rolling wall 8 which is disposed adjacent to the optoelectronic switch 7. The rolling wall 8 has a rolling surface 81 which includes a central area 811 to hold the ball member 3 in the first position, and a surrounding area 812 surrounding the central area 811 to accommodate the ball member 3 in the second position. The emitting and receiving points 62, 72 face towards the central area 811. Thus, as shown in FIG. 9, when the ball member 3 is in the second position, i.e. in the surrounding area 812, a light beam emitting from the emitting point 62 along the light emitting path enters the light receiving path so as to be received by the receiving point 72 and so as to enable the optoelectronic switch 7 to make an electrical connection between the electric contact terminals 61, 71. As shown in FIG. 10, when the ball member 3 is displaced to the first position, i.e. in the central area 811, once the housing 1 is jerked and is tilted to 45 degrees, for example, the light beam emitting from the emitting point 62 along the light emitting path is prevented from entering the receiving path by the ball member 3 to thereby break the electrical connection between the electric contact terminals 61, 71.

The deformable block 2 is U-shaped, and is attached to the surrounding wall 12 adjacent to the infrared light emitter 6. The deformable block 2 confronts the rolling surface 81, and has a through hole 21 that is registered with the emitting slot 16.

The cover 4 is made from an insulating material, and has a base 41 and two protrusions 43 extending downwardly from the base 41 to cover the opened end 14 and to retain the infrared light emitter 6 and the optoelectronic switch 7.

Figure 11:
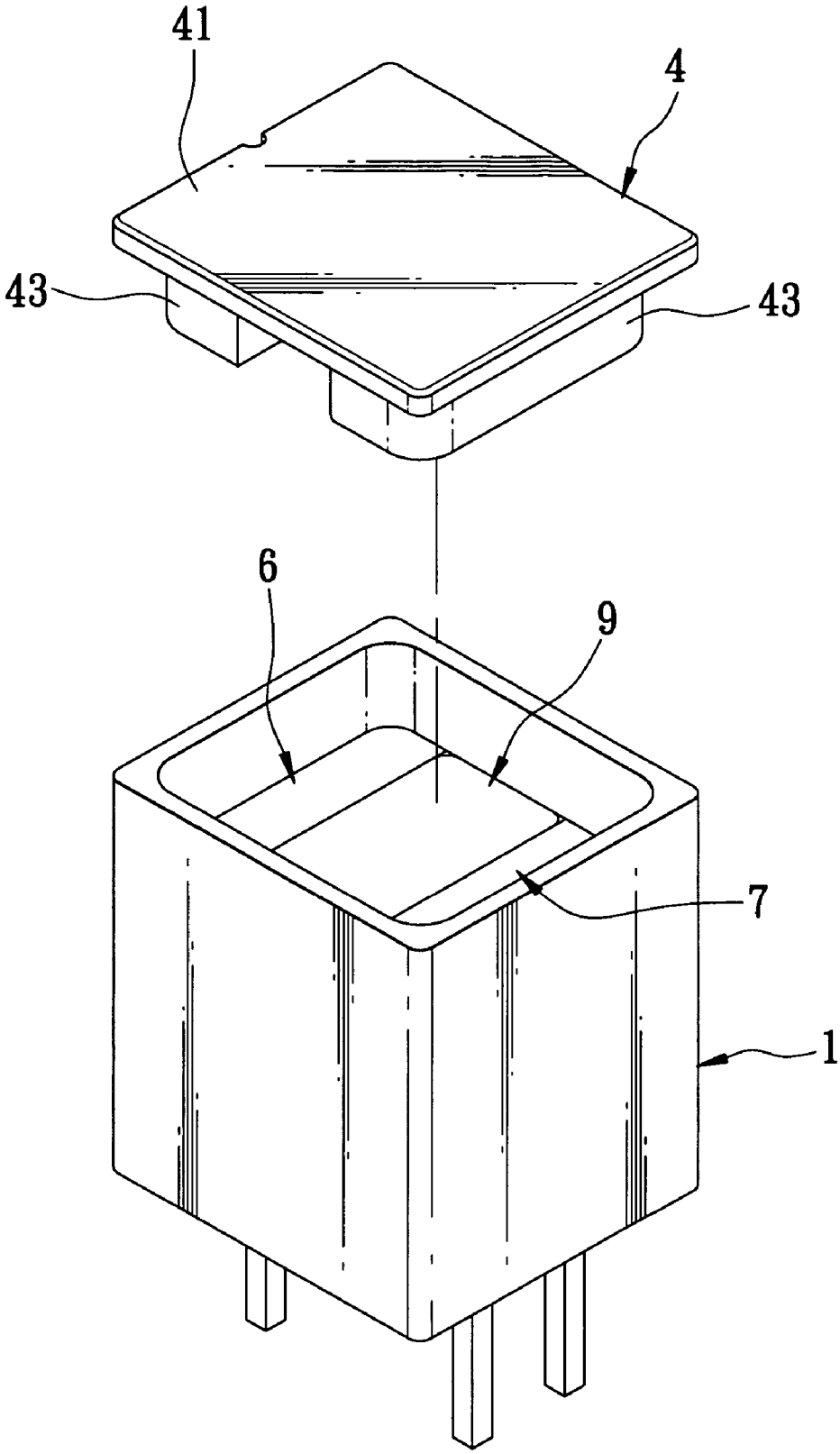
FIG. 11 is an exploded perspective view of the fourth preferred embodiment of a jerk-initiated switch according to this invention.
Figure 12:
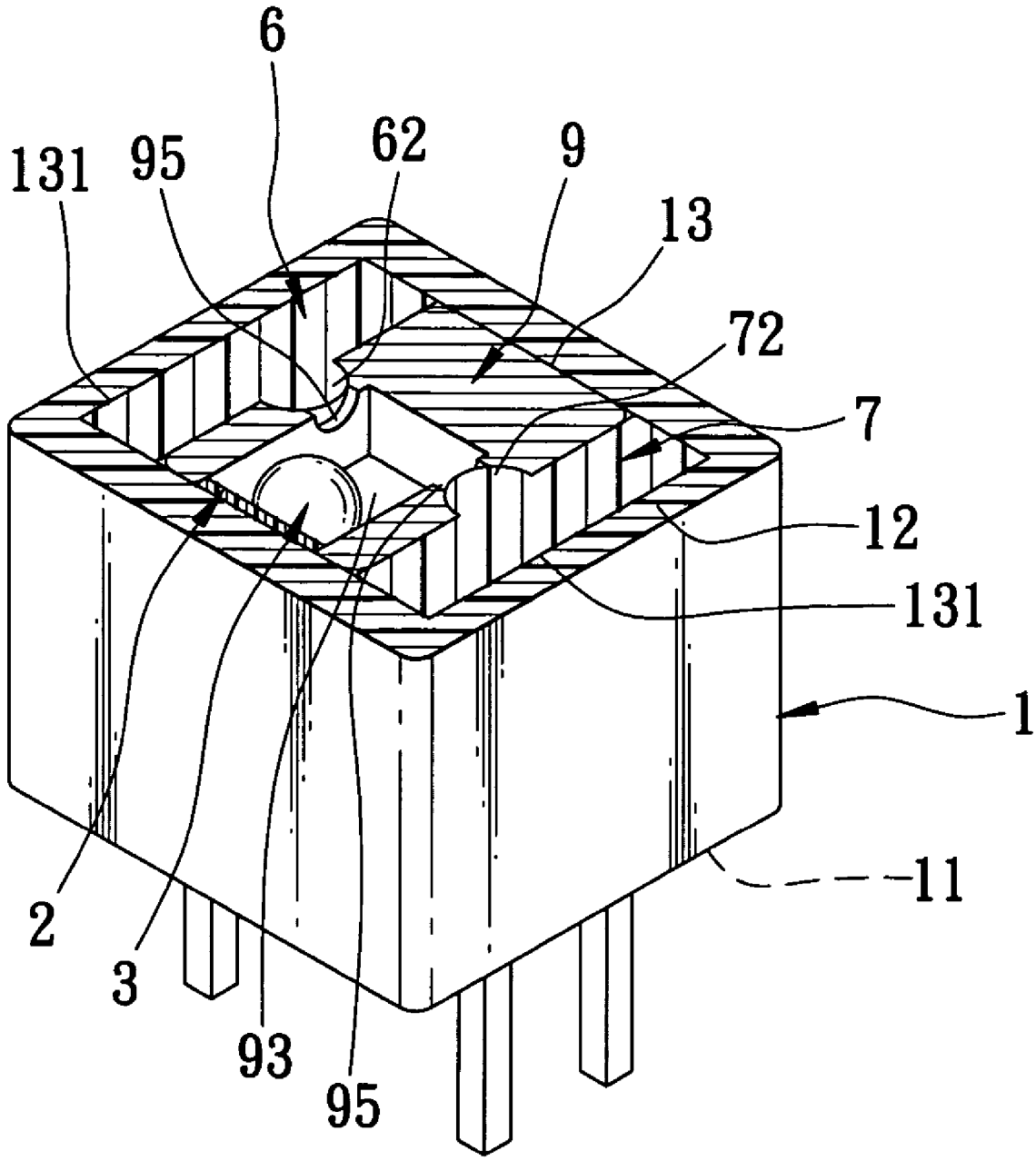
FIG. 12 is a partly cut away perspective view of the fourth preferred embodiment.
Figure 13:
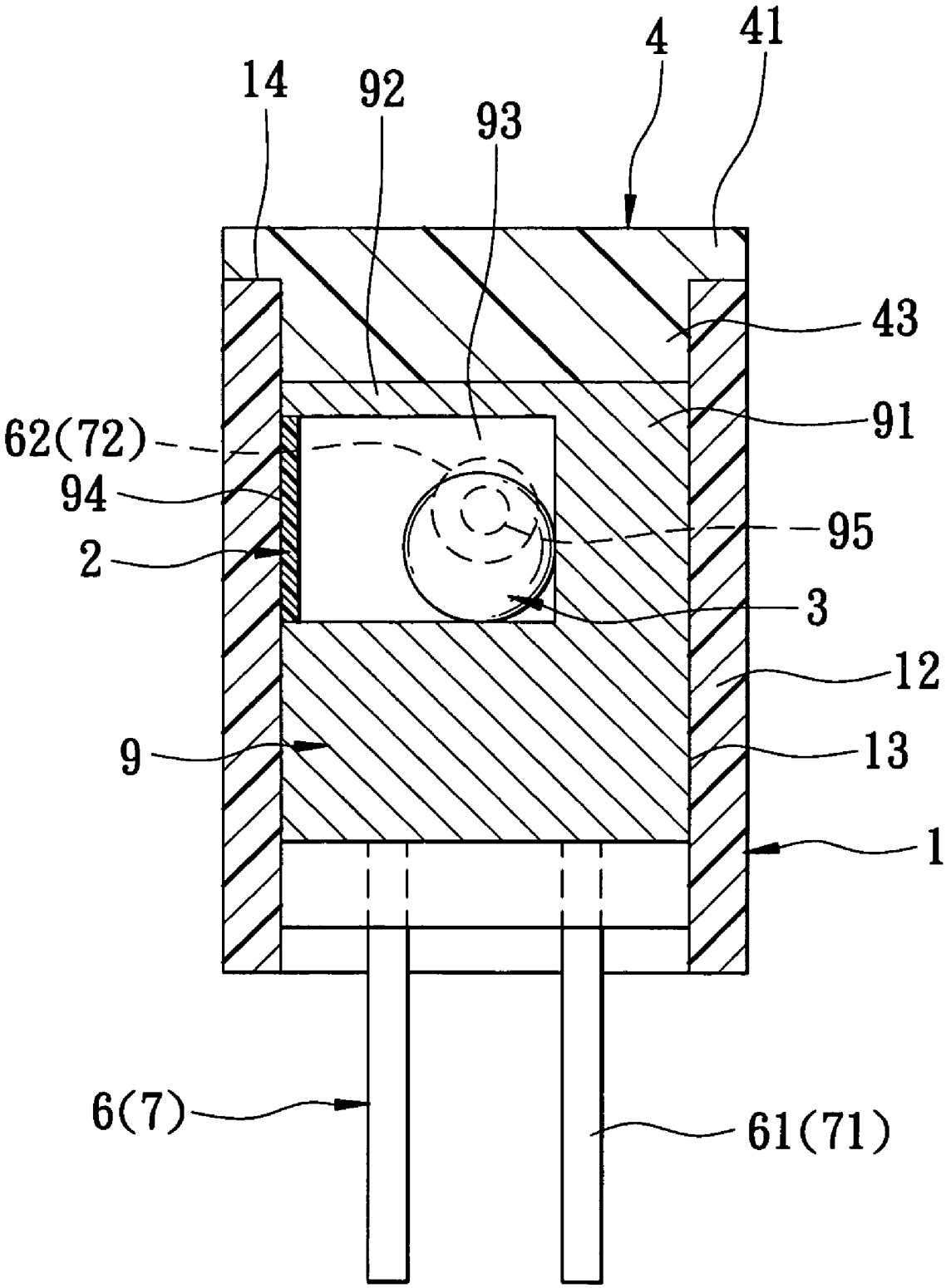
FIG. 13 is a longitudinally sectional view of the fourth preferred embodiment.
Figure 14:
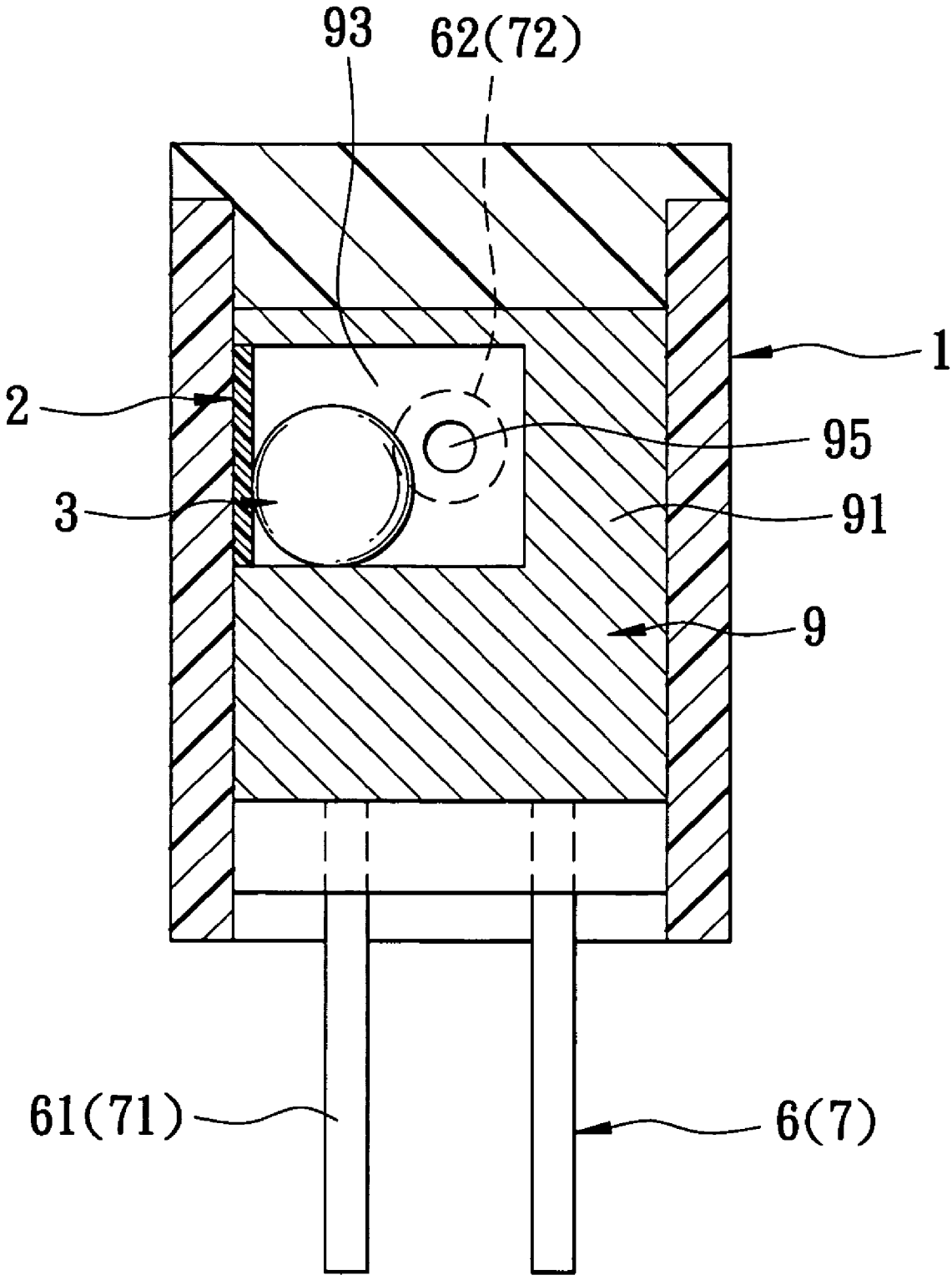
FIG. 14 is a view similar to FIG. 13, but showing the fourth preferred embodiment in a jerked state.

Referring to FIGS. 11 to 13, the fourth preferred embodiment of a jerk-initiated switch according to this invention is similar to the third preferred embodiment in construction, except that the housing 1 has an inner casing wall 9 received in the accommodation chamber 13 such that two concavities 131 are formed at two opposite sides of the inner casing wall 9 for receiving the infrared light emitter 6 and the optoelectronic switch 7. The inner casing wall 9 has a base 91 and a surrounding wall portion 92 which extends from the base 91 to define a rolling space 93 and which terminates at an opening 94 for permitting the ball member 3 to access to the rolling space 93. The deformable block 2 is attached to the surrounding wall 12 of the housing 1 to cover the opening 94. The surrounding wall portion 92 has emitting and receiving slots 95 that are registered with the emitting and receiving points 62, 72. Thus, when the ball member 3 is in the first position, as shown in FIG. 13, a light beam emitting from the emitting point 62 along the light emitting path is prevented from entering the receiving path by the ball member 3 to thereby break the electrical connection between the electric contact terminals 61, 71. As shown in FIG. 14, when the ball member 3 is displaced to the second position, the light beam emitting from the emitting point 62 enters the light receiving path so as to be received by the receiving point 72 and so as to enable the optoelectronic switch 7 to make an electrical connection between the electric contact terminals 61, 71.

Figure 15:
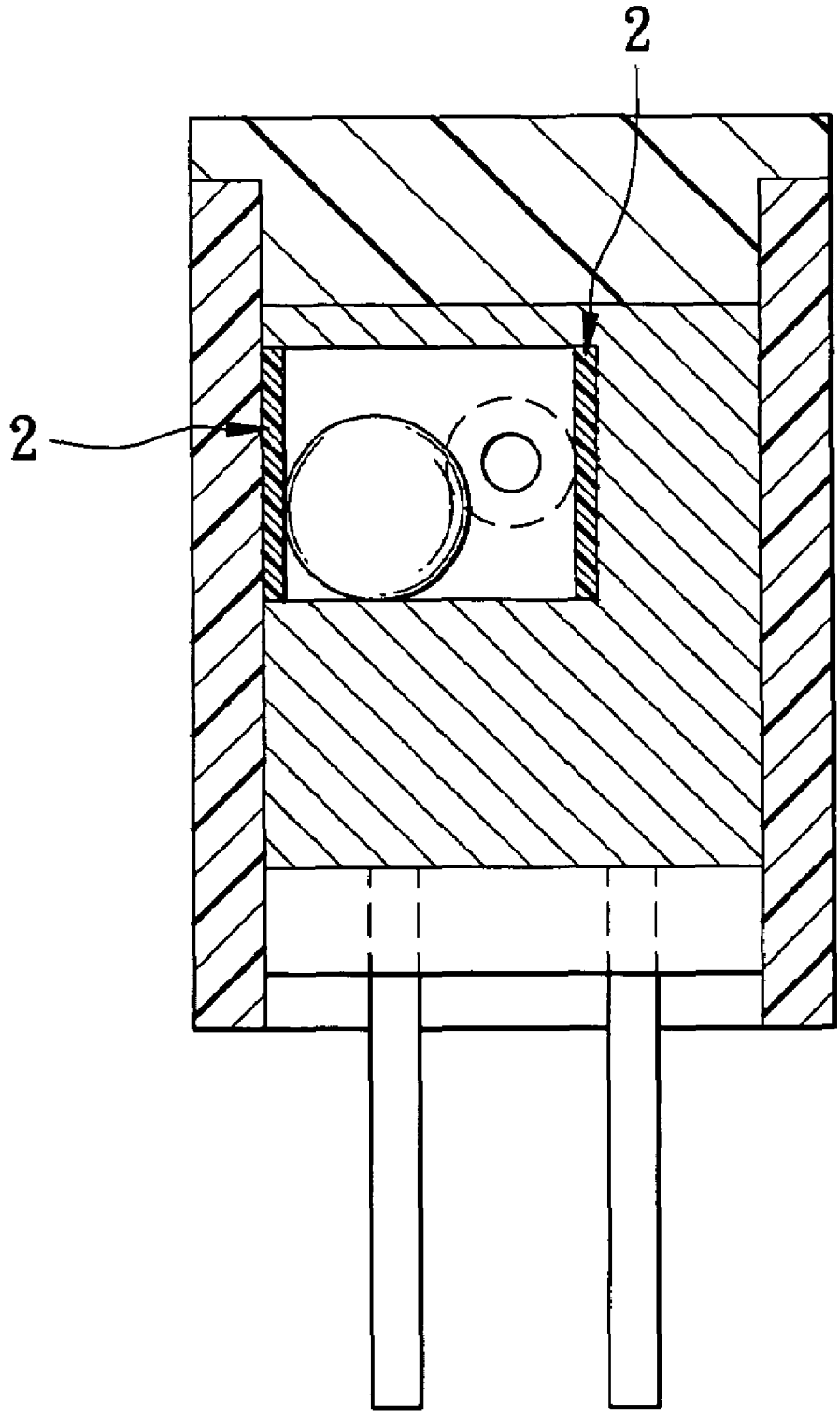
FIG. 15 is a longitudinal sectional view of the fifth preferred embodiment of a jerk-initiated switch according to this invention.

Alternatively, referring to FIG. 15, in the fifth preferred embodiment, the momentum reducing member of the jerk-initiated switch according to this invention is shown to include two deformable blocks 2 which are opposite to each other in the transverse direction across the light emitting and receiving paths.

As illustrated, according to this invention, when the switch is jerked, the momentum reducing member will yield (i.e., deformed and moved) under impact from the ball member 3 so as to reduce the momentum of the ball member 3, thereby reducing the clattering sound generated by the ball member 3 hitting against the housing 1.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A jerk-initiated switch adapted to be mounted on and to be in electric contact with a support, said jerk-initiated switch comprising:

a housing adapted to be mounted on the support in an upright direction, and having an inner housing wall which defines an accommodation chamber therein;

first and second terminals which are disposed to define a switching action enabling path of a straight length that crosses said accommodation chamber, and which are coupled to effect a change of an electric switching state in response to an interruption of said switching action enabling path;

a ball member received rollably in said accommodation chamber, said ball member being configured such that when said housing is jerked, said ball member is displaceable from a first position, where said ball member is disposed to interrupt said switching action enabling path so as to establish a first electric switching state, to a second position, where said ball member is disposed outside said switching action enabling path so as to establish a second electric switching state; and a momentum reducing member which is disposed in said accommodation chamber, and which is configured to yield under impact from said ball member so as to reduce momentum of said ball member when said ball member is displaced from the first position to the second position, wherein said ball member directly engages said momentum reducing member in the second position, and disengages from said momentum reducing member in the first position.

2. The jerk-initiated switch of claim 1, wherein said momentum reducing member includes a deformable block which is deformed upon receiving an impact from said ball member.

3. The jerk-initiated switch of claim 2, wherein said first terminal is integrally formed with said inner housing wall of said housing, each of said first and second terminals and said ball member being made of an electrically conductive material such that when said ball member is in the first position to interrupt said switching action enabling path, said ball member is in contact with said first and second terminals so as to establish the first electric switching state, and such that when said ball member is in the second position to be outside said switching action enabling path, said ball member is out of contact with at least one of said first and second terminals so as to be placed in the second electric stitching state.

4. The jerk-initiated switch of claim 3, wherein said deformable block is movably received in said accommodation chamber so as to be moved away from said switching action enabling path upon receiving an impact from said ball member.

5. A jerk-initiated switch adapted to be mounted on and to be in electric contact with a support. said jerk-initiated switch comprising:

a housing adapted to be mounted on the support in an upright direction, and having an inner housing wall which defines an accommodation chamber therein;

first and second terminals which are disposed to define a switching action enabling path of a straight length that crosses said accommodation chamber, and which are coupled to effect a change of an electric switching state in response to an interruption of said switching action enabling path;

a ball member received rollably in said accommodation chamber, said ball member being configured such that when said housing is jerked, said ball member is displaceable from a first position, where said ball member is disposed to interrupt said switching action enabling oath so as to establish a first electric switching state, to a second position, where said ball member is disposed outside said switching action enabling oath so as to establish a second electric switching state; and a momentum reducing member which is disposed in said accommodation chamber, and which is configured to yield under impact from said ball member so as to reduce momentum of said ball member when said ball member is displaced from the first position to the second position, wherein said first terminal is integrally formed with said inner housing wall of said housing, each of said first and second terminals and said ball member being made of an electrically conductive material such that when said ball member is in the first position to interrupt said switching action enabling path, said ball member is in contact with said first and second terminals so as to establish the first electric switching state, and such that when said ball member is in the second position to be outside said switching action enabling path, said ball member is out of contact with at least one of said first and second terminals so as to be placed in the second electric stitching state, wherein said momentum reducing member includes a deformable block which is deformed upon receiving an impact from said ball member, which is secured on said inner housing wall, and which is disposed at an opposite side of said accommodation chamber relative to one of said first and second terminals, said deformable block being disposed proximate to the second position of said ball member and distal from the first position of said ball member, and a rollable body which is interposed between said ball member and said deformable block and which is larger that said ball member in mass such that the momentum of said ball member is reduced when said ball member is displaced and impacts against said rollable body.

6. The jerk-initiated switch of claim 2, wherein said housing is made from an insulating material, said jerk-initiated switch further comprising:

an optoelectronic sensor member secured to said housing, and including light emitting and receiving units which are disposed opposite to each other in a transverse direction relative to the upright direction to serve as said first and second terminals and which respectively define a light emitting path and a light receiving path that cooperatively serve as said switching action enabling path, and two electric contact terminals which are electrically connected to said light receiving unit and which extend downwardly and outwardly of said housing so as to be adapted to be connected electrically to the support;

said ball member disposed such that a light beam emitting from said light emitting unit along the light emitting path enters the light receiving path when said ball member is in the second position so as to be received by said light receiving unit and so as to enable said light receiving unit to make an electrical connection between said electric contact terminals, and such that when said ball member is in the first position, the light beam emitting from said light emitting unit along the light emitting path is prevented from entering the light receiving path by said ball member to thereby break the electrical connection between said electric contact terminal.

7. The jerk-initiated switch of claim 6, wherein said optoelectronic sensor member includes an infrared light emitter which has an emitting point and which serves as said light emitting unit, and an optoelectronic switch which has a receiving point and which serves as said light receiving unit.

8. The jerk-initiated switch of claim 7, wherein said inner housing wall has a rolling surface which is disposed adjacent to said optoelectronic switch, and which includes a central area to accommodate said ball member in the first position, and a surrounding area surround said central area to accommodate said ball member in the second position, said emitting and receiving points facing towards said central area such that when said ball member is displaced to said central area, the light beam emitting from said emitting point is prevented from entering said receiving path by said ball member to thereby break the electrical connection between said electric contact terminals.

9. The jerk-initiated switch of claim 8, wherein said deformable block is attached to said inner housing wall and adjacent to said infrared light emitter.

10. The jerk-initiated switch of claim 7, wherein said housing has two concavities disposed opposite to each other for retaining said infrared light emitter and said optoelectronic switch therein respectively, said inner housing wall having emitting and receiving slots which are spaced apart from each other and which are communicated with said concavities to form said light emitting and light receiving paths, respectively.

11. The jerk-initiated switch of claim 10, wherein said deformable block is secured on said inner housing wall and is disposed proximate to the second position of said ball member and distal from the first position of said ball member.

* * * * *